United States Patent [19]

Benedetti et al.

[11] Patent Number: 4,765,772

[45] Date of Patent: Aug. 23, 1988

[54] METHOD AND APPARATUS FOR FILLING VOIDS IN RECYCLED ASPHALT

[75] Inventors: Angelo W. Benedetti; Angelo W. Benedetti, Jr., both of Bedford, Ohio

[73] Assignee: Angelo Benedetti, Inc., Bedford, Ohio

[21] Appl. No.: 55,600

[22] Filed: May 29, 1987

[51] Int. Cl.[4] ..... E01C 7/00; E01C 19/12; E01C 19/22

[52] U.S. Cl. ..... 404/77; 404/96; 404/101; 404/102; 404/108; 404/114; 404/118; 239/683; 239/687

[58] Field of Search ..... 404/77, 79, 84, 90–92, 404/95, 96, 101, 102, 108, 110, 111, 113, 114, 118–120; 239/682, 683, 684, 687; 222/293

[56] References Cited

U.S. PATENT DOCUMENTS

| | | | |
|---|---|---|---|
| 3,129,846 | 4/1964 | Van der Lely et al. | 239/683 X |
| 3,398,662 | 8/1968 | Takata et al. | 404/108 X |
| 3,539,113 | 11/1970 | Tyler | 239/684 X |
| 3,880,542 | 4/1975 | Mullen | 404/101 |
| 3,909,146 | 9/1975 | Hoffman | 404/110 |
| 3,970,404 | 7/1976 | Benedetti | 404/77 |
| 3,997,277 | 12/1976 | Swisher, Jr. et al. | 404/84 |
| 4,145,154 | 3/1979 | Mingot | 404/108 X |
| 4,196,827 | 4/1980 | Leafdale | 404/111 X |
| 4,205,793 | 6/1980 | Van der Lely | 239/682 |
| 4,364,690 | 12/1982 | Bruns | 404/118 |
| 4,379,653 | 4/1983 | Brown | 404/118 |
| 4,643,360 | 2/1987 | Van der Lely et al. | 239/682 |

FOREIGN PATENT DOCUMENTS

| | | | |
|---|---|---|---|
| 2038046 | 2/1972 | Fed. Rep. of Germany | 404/108 |

*Primary Examiner*—Jerome Massie, IV
*Assistant Examiner*—John F. Letchford
*Attorney, Agent, or Firm*—H. Jay Spiegel

[57] ABSTRACT

Disclosed herein is a method and apparatus for filling voids in recycled asphalt. When asphalt has been recycled through the use of a heater-scarifier-screed apparatus, inherently, the pavement surface has voids therein which render the surface porous. The apparatus disclosed herein spreads a thin layer of asphalt over the recycled asphalt in such a manner that substantially all of the voids in the surface thereof are filled. When the method disclosed herein has been completed, the result is a substantially smooth, recycled, repaved trafficable asphalt surface.

39 Claims, 5 Drawing Sheets

METHOD AND APPARATUS FOR FILLING VOIDS IN RECYCLED ASPHALT

BACKGROUND OF THE INVENTION

Applicants, first, wish to incorporate by reference U.S. Pat. No. 3,970,404 issued on July 20, 1976 to co-inventor Angelo W. Benedetti. This patent discloses a method of reconstructing asphalt pavement wherein the pavement is heated with radiant energy until the pavement surface achieves a temperature within the range of 225° F. to about 325° F. to thereby soften the pavement surface. Thereafter, the application of radiant energy is discontinued to permit the heat applied to be conducted deeper into the asphalt pavement without overheating the surface to thereby soften the asphalt pavement to an incremental depth. Thereafter, the previously heated surface is reexposed to a source of radiant energy to elevate its energy to a value not exceeding about 325° F. to thereby further soften the surface thereof. Thereafter, the application of radiant energy is discontinued to permit the heat last applied to be conducted deeper into the asphalt pavement without overheating the surface, thereby further softening the asphalt pavement to a further incremental depth.

Thereafter, the thereby softened asphalt is scarified to a depth not exceeding the further incremental depth so as to eliminate any surface cracks or discontinuities therein. Thereafter, a leveling operation is accomplished through the use of a screed to level the pavement, whereupon rolling, compacting and rejuvenation steps are thereafter applied.

The method described in U.S. Pat. No. 3,970,404 and basically explained above was quite effective in recycling an asphalt surface, however, when the process described in U.S. Pat. No. 3,970,404 was completed, the pavement was filled with voids. In the paving industry, voids are defined as areas where there is no sand or asphalt and water may collect in these voids whereupon the subsequent intrusion into the pavement structure acts, over a period of time, to delaminate the pavement through repeated freezing and thawing as well as dilution of the asphalt mix through the addition of water thereto.

In the method described in U.S. Pat. No. 3,970,404, the top layer of the original asphalt surface, to a depth of approximately one inch was recycled. Due to the fact that the above-described voids were always created when an asphalt surface was recycled through the use of that method, after the leveling step thereof, as shown in the sole figure therein, an overlay had to be applied over the recycled surface so that the resulting road surface would be smooth and durable. Experience showed that the overlay had to be at least ⅝ inch thick over the recycled asphalt. This was because the aggregate which comprises one of the constituent parts of the asphalt mix includes stones which are up to ⅝ inch in diameter and with these stones utilized in the aggregate, the thickness of the new layer could not be reduced below the stone diameter otherwise bumps and discontinuities would result in the overlay. On the other hand, it was discovered that if the overlay was made up of sand aggregate, the overlay did not have sufficient strength to maintain continuity over the road surface over any extended period of time.

Some paving contractors tried to solve the problem of voids by filling the voids with sand and mineral fillers but such methods were quite time consuming and expensive and did not guarantee that the voids would be eliminated. In this regard, in filling the voids with sand and mineral fillers, if the resulting surface was not completely smooth, this resulted in additional voids being formed by the surface structure of the fillers. Thus, where a plurality of voids had been added by the use of fillers, the pavement became slick and slippery which caused the road surface to become dangerous.

Other problems resulted from the fact that an additional overlay of at least ⅝ inch had to be applied over the repaved asphalt surface. Firstly, due to the increase in the actual level of the surface of the road which results from providing such a thick overlay, all of the man-holes, water boxes and inlet basins of a road had to be raised. In any paving contract, raising these structures normally costs approximately 20% of the total contract price. Thus, stated another way, the fact that a thick overlay had to be applied resulted in a vast increase in the cost of repaving due to the fact that one important contract item consisted of the labor charges for raising all of the road structures which would otherwise be covered by the overlay.

Furthermore, due to the thickness of the overlay, paving contractors had to be quite careful not to disturb the drainage which had been built into the original road surface due to its angle, and utility castings had to be adjusted to a new height.

In another aspect, in order to add a ⅝ inch overlay to an existing road surface, a great deal of energy resources must be expanded. It is well known by those skilled in the paving industry that asphalt includes as a constituent part petroleum. In fact, for every ton of asphalt which includes stone, sand and liquid, approximately 120 pounds of the ton consists of petroleum. Applicants have discovered that one ton of asphalt spread approximately 1 inch thick covers approximately 150 square feet. Thus, a roadway 1 mile long and 10 feet wide paved 1 inch thick would require approximately 350 tons of asphalt of which approximately 21 tons would consist of petroleum. As it must be understood, in order to apply an overlay of asphalt to a road surface, the road surface and the overlay must be heated as described above to a temperature of at least 225° F. and the thicker the overlay the more energy is required to elevate the asphalt to the appropriate temperature. Furthermore, large expenditures of energy resources are required to mine the stone, wash it, truck it and heat it, and the same applies to the sand which is utilized.

Further, applicants are aware of the U.S. Pat. No. 4,643,360 to van der Lely et al. which discloses a spreader in several embodiments. The embodiments include devices including plural spinners, and different embodiments of hopper and discharge details. In the embodiment shown in particular in FIGS. 1 and 3, the discharge port on the hopper is conically shaped with a protruding floor having a radially disposed cavity and two radially disposed distribution vanes which are fixed in position. Two openings, 29 and 30, are formed on the conical collar wall which lead to a distribution plate which is upwardly angled and has 4 distribution paddles which are curved both in the vertical and horizontal direction. The manner of adjustment of the openings 29 and 30 is such that as the openings are adjusted, their axis of symmetry shifts circumferentially about the distribution device. In the embodiment shown in FIGS. 7–10, the outlet port on the spreader is a cylindrical collar, however, the distribution device comprises a conical device having curved vanes which extend outwardly from the central axis of rotation of the device and which are nonadjustable. The outer distribution plate of the spreader disclosed in FIGS. 7–10 appears to be the same as that which is disclosed in FIGS. 1–6.

Several significant differences exist between the teachings of the van der Lely et al. patent and the teachings of the present invention. Firstly, each of the embodiments of van der Lely et al. include structure in their inner chambers which would not work in the environment of spreading of asphalt materials. In the embodiment best seen in FIG. 3, the conical nature of the distribution collar and the fact that the outlet openings are formed on this conical member cause a vertical component of discharge which results in bouncing of the material on the distribution plate 43 which is quite disadvantageous when one is spreading a heavy material such as asphalt. Furthermore, since the distribution vanes in the inner chamber designated by the reference numeral 57 and best seen in FIG. 2, extend directly radially outwardly from the axis 13 of rotation of the device, very little mechanical advantage is obtained in the central portions thereof and the likelihood exists that asphalt materials would cling to the central portions of the vanes 57 and build-up causing clogging of the device. The same effect would happen on the outlets 29 and 30 because even though their combined area may equal the total area of the single distribution port of the present invention, the fact that the total area is comprised of two smaller openings would cause additionally clumping and clotting of the openings with the asphalt material as it caught in the region between the openings 29 and 30 and accumulated and hardened.

On the other hand, concerning the embodiment of FIGS. 7–10, the conical nature of the distribution device causes a restricted area to be formed adjacent to the outlets which would cause further clotting of the material and clogging of the distribution path. In a further aspect, with reference back to FIGS. 1 and 3, the region between the plate 40 and the conical collar 25 is an area where if used to distribute asphalt, the asphalt would accumulate, cool and harden thus causing disruption of the proper operation of the device. Furthermore, common to both embodiments of van der Lely et al., is the structure of the paddles 53. Firstly, they are nonadjustable and their curvature in the horizontal and vertical directions as well as their up-lifted nature best seen in FIG. 3 are all designed to enable the throwing of large quantities of material a great distance. In this regard the patent discloses throwing material as far as 25 meters. Contrary to this teaching, in the present invention, it is specifically intended that small quantities of material be distributed over a radius of no more than 3 to 4 feet from each spinner with even distribution in that area. With asphalt material being composed of aggregate of varying sizes, if it were to be thrown with distribution paddles such as those designated by the reference numeral 53 in van der Lely et al., the result would be a quite uneven distribution as aggregate of different sizes would be thrown non-uniform distances from the distribution plate thereof.

In contrast to these teachings of van der Lely et al., the present invention includes inner and outer paddles each of which is adjustable for angle and each of which consists of a straight elongated member to maximize the ability to move heavy material outwardly while minimizing the ability to throw the material a great distance. In this way, a uniform pattern of distribution is possible through the teachings of the present invention.

In a further aspect, concerning the teachings of van der Lely et al., as stated above, when the openings 29 and 30 are adjusted as to their size, the line of symmetry about which the openings extend is circumferentially moved. As opposed to this, in the present invention as will be discussed in greater detail hereinafter, it is crucial that the axis of symmetry about which the opening extends is maintained in the same position approximately 45° from the longitudinal axis of the machine. Applicants have found that through placement of the opening at that region, more uniform distribution of material throughout the swath of pavement being repaved and recycled occurs.

Furthermore, in the present invention, adjustments of the thickness of the material distributed may be accomplished in six ways, through adjustment of the size of the distribution opening, through adjustments of the angle of attack of the internal paddles, through adjustments of the angle of attack of the outer paddles, through changes in the speed of movement of the device itself, through adjustments in speed of rotation of the spinners, and through any combination of adjustments of the above. Since the van der Lely device depends for its operation on interconnection with the power take-off shaft of the supporting tractor, as the speed of the supporting tractor increases, so does the speed of the spinners proportionally. Thus, the only way to adjust the speed of rotation of the spinners of the van der Lely device is through changes in the speed of forward movement of the device. This is completely different from the teachings of the present invention.

Furthermore, van der Lely et al. disclose the ability to adjust the position of the ports 29 and 30 about the rotary axis 13 and disclose structure for performing this function. This indicates that in the van der Lely device there is no criticality in the particular position of the ports 29 and 30 about the rotation axis 13. This is to be contrasted with the teachings of the present invention where there is extreme criticality in the particular position of the single outlet port thereof. Furthermore, in the present invention, it is contemplated that the spinners rotate in the range of approximately 10 to 50 revolutions per minute. This is extremely slow rotation as compared to what may be inferred from the teachings of van der Lely et al. since the van der Lely spinners would have to rotate at much higher speeds in order to throw any material 25 meters as is disclosed therein.

Finally, the cylindrical nature of the outlet collar of the present invention combined with the flat bottom of the chamber formed thereby allow large aggregate materials to be dispensed therefrom without clogging or clumping of the materials and thereby disrupting the operation of the machine. This is contrasted with the teachings of van der Lely et al. which show structure which if used in the environment of spreading of asphalt aggregate materials would cause clumping, clogging and quite definite impediment of the smooth flow and distribution of materials from the device.

Accordingly, for the reasons set forth hereinabove, applicants believe that the present invention clearly patentably distinguishes in all respects from the teachings of van der Lely et al.

Accordingly, in light of the above-described problems in the asphalt paving industry, including those discussed with reference to U.S. Pat. No. 4,643,360, a need has developed for a machine and method which could be utilized to apply an extremely thin overlay over a repaved asphalt surface so that all voids could be filled while saving energy over prior methods, while eliminating the need for adjustments to man-holes, water boxes and inlet basins.

SUMMARY OF THE INVENTION

The present invention overcomes the deficiencies in prior methods and apparatuses and provides a new method and apparatus which enables a paving contractor to apply an overlay as thin as 1/7 inch, which overlay results in a substantially completely smooth pavement surface. This is accomplished through the use of an asphalt spreading device disclosed in detail hereinbelow which spreads a thin layer of asphalt over an already paved asphalt surface in a manner which combined with a rolling step results in filling of all voids and smoothing of the pavement surface.

In order to better understand the teachings of the present invention, it is important to first note the changes in the method taught in U.S. Pat. No. 3,970,404 which changes are done in order to facilitate the inclusion of the inventive apparatus and method within the entire paving process.

In this regard, with particular reference to the sole figure in U.S. Pat. No. 3,970,404, the process illustrated in this figure is carried out through the leveling step. After the leveling step, the overlay spreading device of the present invention immediately follows whereupon the overlay is spread over the repaved asphalt surface. Immediately following the spreading of the overlay on the repaved asphalt surface, a screed is applied over the loose overlay, not to level the overlay surface, but rather to assist in uniformly spreading and smoothing the overlay so that all voids will be filled. The spreading effect of the screed is enhanced by vibratory motion thereof and the screed is also heated so that the surface of the repaved asphalt roadway is maintained above approximately 225° F. Regarding the screed heating, the screed has little heat transfer ability. It is heated only to assist the material in flowing underneath it. The warmer the screed, the less the adhesion of the asphalt to it.

Immediately following the spreading of the overlay through the use of the spreading heated and vibratory screed, a roller follows to compact the overlay and repaved road into a smooth surface.

Thereafter, after the overlay has been smoothed by the floating screed which follows the overlay spreading device, and a roller has been utilized to further smooth and compress the finished pavement, a rejuvenating coating may be sprayed on the rolled surface to finally seal the pavement and provide its finished appearance.

It is important to note that due to the fact that the overlay which is applied in accordance with the teachings of the present invention may be as thin as approximately 1/7 inch as opposed to the minimum $\frac{5}{8}$ inch overlay which is required in prior art methods, great savings in energy resources are attained. The energy which must be expended in applying a $\frac{5}{8}$ inch overlay is detailed hereinabove. Through the teachings of the present invention, the overlay which is applied over the repaved asphalt surface includes only about 1/5 of the asphalt which is required through conventional overlaying techniques. Thus, through the teachings of the present invention, only about 1/5 of the petroleum reserves which are necessary to provide the prior art overlay must be used through the teachings of the present invention, only 1/5 of the energy necessary to mine, wash and convey the aggregate and sand to the point of use must be used, only 1/5 of the energy which must be expended in heating the overlay during application is required. Thus, the energy savings over the prior art method of applying overlay are extremely significant in our energy conscious society. Inventions which, when applied in the marketplace, result in savings in energy are extremely important because they reduce our dependency upon foreign energy reserves such as petroleum reserves. As such, the savings in energy which are attributable to application of the teachings of the present invention are extremely significant.

Accordingly, it is a first object of the present invention to provide an improved apparatus for applying an overlay on a recycled asphalt road surface.

It is a further object of the present invention to provide such an improved apparatus which may be utilized in practicing a method of applying an overlay over a repaved asphalt surface.

It is a still further object of the present invention to provide such an apparatus and method which may be utilized to apply an overlay which is much thinner than overlays which are required through the use of prior art methods and apparatuses.

It is a still further object of the present invention to provide such an improved method and apparatus which, when applied, will result in great savings in the municipal expense of paving contracts due to the elimination of the requirement to raise man-hole covers, water boxes and inlet basins due to the great thickness of prior art overlays.

These and other objects, aspects and features of the inventive apparatus and method will be better understood from the following detailed description of the preferred embodiments thereof when read in conjunction with the appended drawing figures.

SPECIFIC DESCRIPTION OF THE PREFERRED EMBODIMENTS

Figure 1:
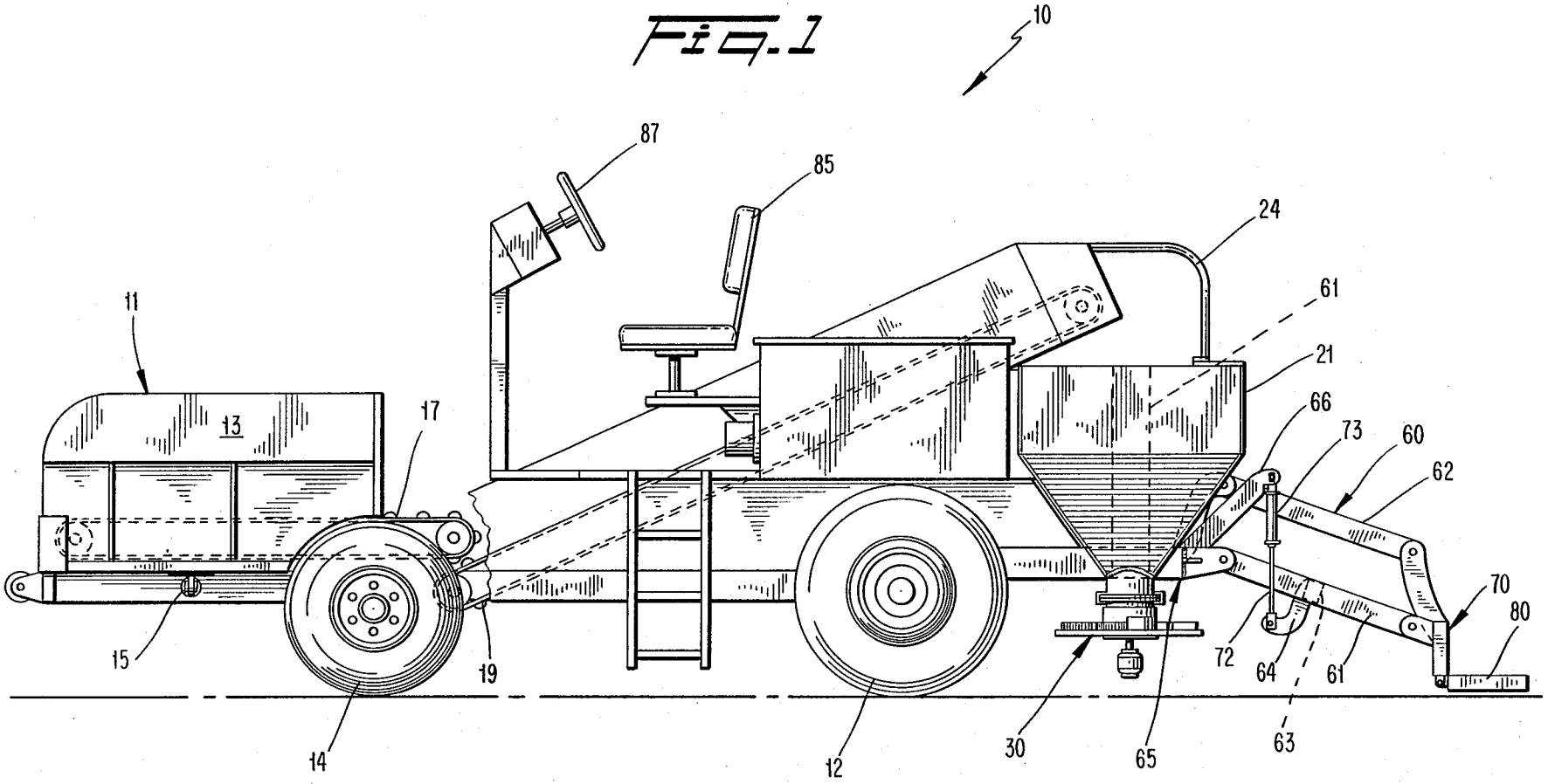
FIG. 1 shows a side view of the inventive overlay spreading device.
Figure 2:
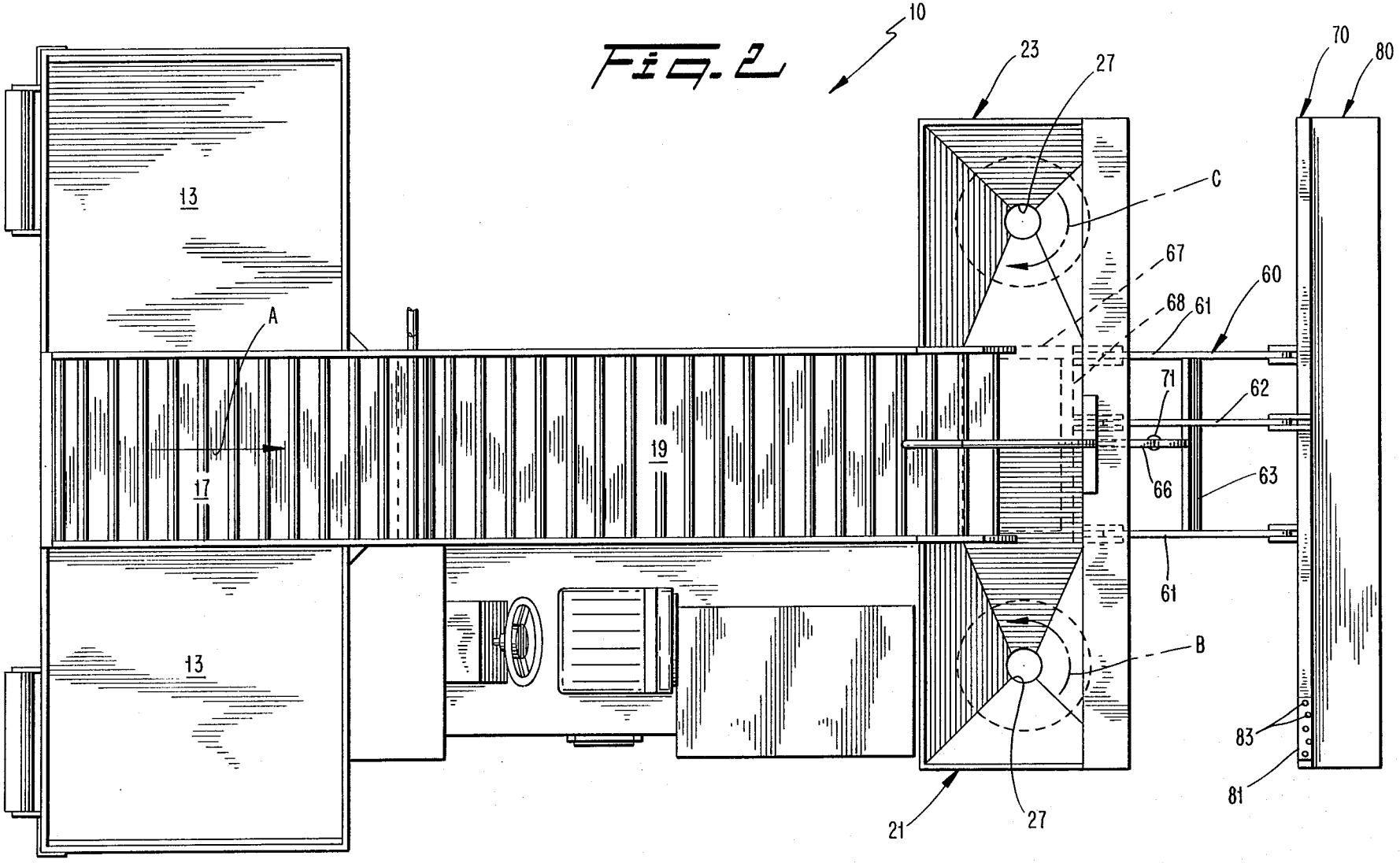
FIG. 2 shows a top view of the device illustrated in FIG. 1.

With reference first to FIGS. 1 and 2, the inventive overlay spreading device is designated by the reference numeral 10 and is seen to include a front hopper 11 having sides 13 which are pivotable through actuation of rams 15. The front hopper 11 is designed to be filled with the asphalt overlay material and the pivotable nature of sides 13 allows adjustment of the angle of the sides 13 so that the asphalt overlay material will not stick to the sides 13 and will fall through the force of gravity to the center of the front hopper 11.

With particular reference to FIG. 2, it is seen that centrally mounted within the front hopper is a conveying mechanism 17 which may be activated in a manner well-known to those skilled in the art so that asphalt overlay material which falls to the center of the front hopper 11 may be conveyed in the direction of the arrow A in FIG. 2 toward the rear of the device 10.

As seen with reference to FIGS. 1 and 2, the conveyor 17 carries the material in the direction of the arrow A until the material is conveyed to a second conveyor 19 which conveys the material upwardly to dump the material in a pair of rear hoppers 21 and 23. Deflector plate 24 interacts with second conveyor 19 to cause the hoppers to be uniformly filled with material front to back.

As best seen in FIG. 2, the rear hoppers 21, 23 comprise skewed rectangular pyramids with a wall 25 defining an intersection of the hoppers 21, 23 and with the wall 25 being centrally located below the rearward extent of the conveyor 19. Thus, the conveyor 19 will convey the asphalt overlay material until the material spills over the wall 25 wherein the material is bisected and guided by the plate 24 to evenly fill the rear hoppers 21, 23.

Figure 3:
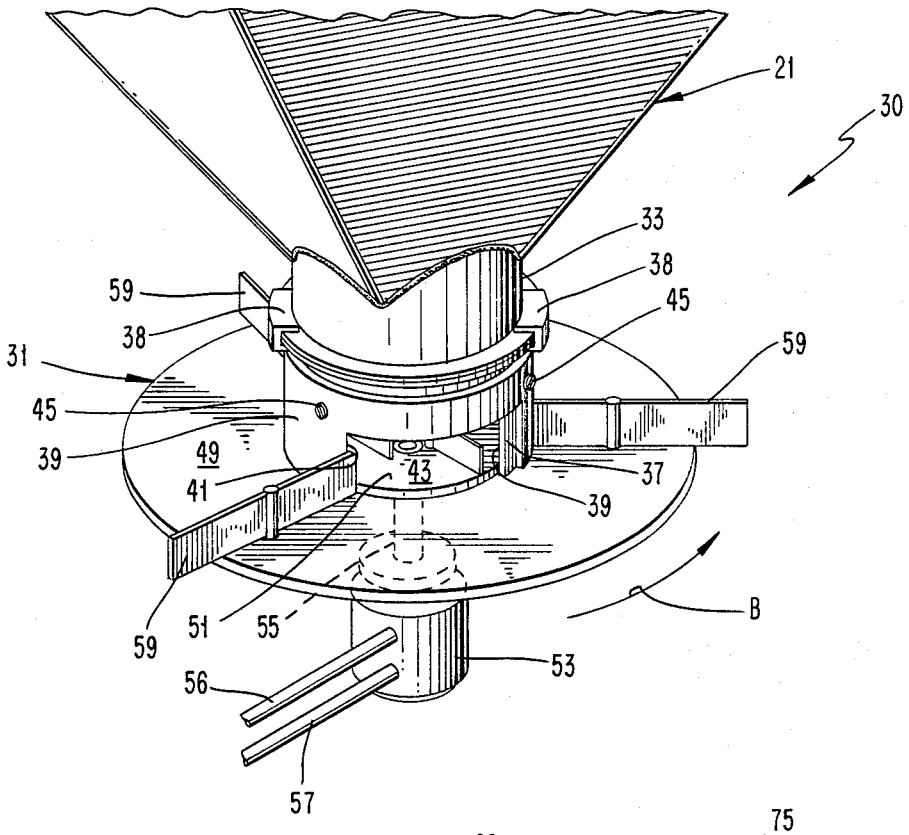
FIG. 3 shows an enlarged view of one of the spinners of the inventive overlay spreading device.

With reference to FIGS. 1, 2 and 3, it is seen that the hoppers 21 and 23 each have a bottom opening 27 which leads to a spinner mechanism 30.

With reference to FIG. 3, the hopper 21 and associated spinner mechanism 30 are shown. The spinner mechanisms attached to each hopper 21 and 23 correspond to one another with the left-hand spinner mechanism 30 having a distribution plate 31 spinning in the direction of the arrow B, whereas the right-hand spinner mechanism 30 includes a distribution plate 31 which spins in the direction of the arrow C.

With reference to FIG. 3, the rear left-hand hopper 21 is seen to include a cylindrical terminus defining the opening 27 best seen in FIG. 2. A shoulder 35 is provided at the bottom of the cylindrical terminus 33 and has attached thereto through suitable means such as, for example, quick release vice grip clamps 38, a collar 37. The collar 37 includes an elongated opening 39. Concentrically disposed about the collar 37 is a further collar 39 having an opening 41 which combines with the opening 39 in the collar 37 to provide a lateral discharge opening 43 which continues the flow path defined by the opening 27. Set screws 45 are threadably engaged within threaded openings formed within the follar 39 and the ends (not shown) of the set screws 45 bearingly engage the outer surface of the inner collar 37 in a frictional engagement so as to maintain the rotative relationship between the collars 37 and 41 and thereby the size of the opening 43 formed by such angular position.

Figure 5:
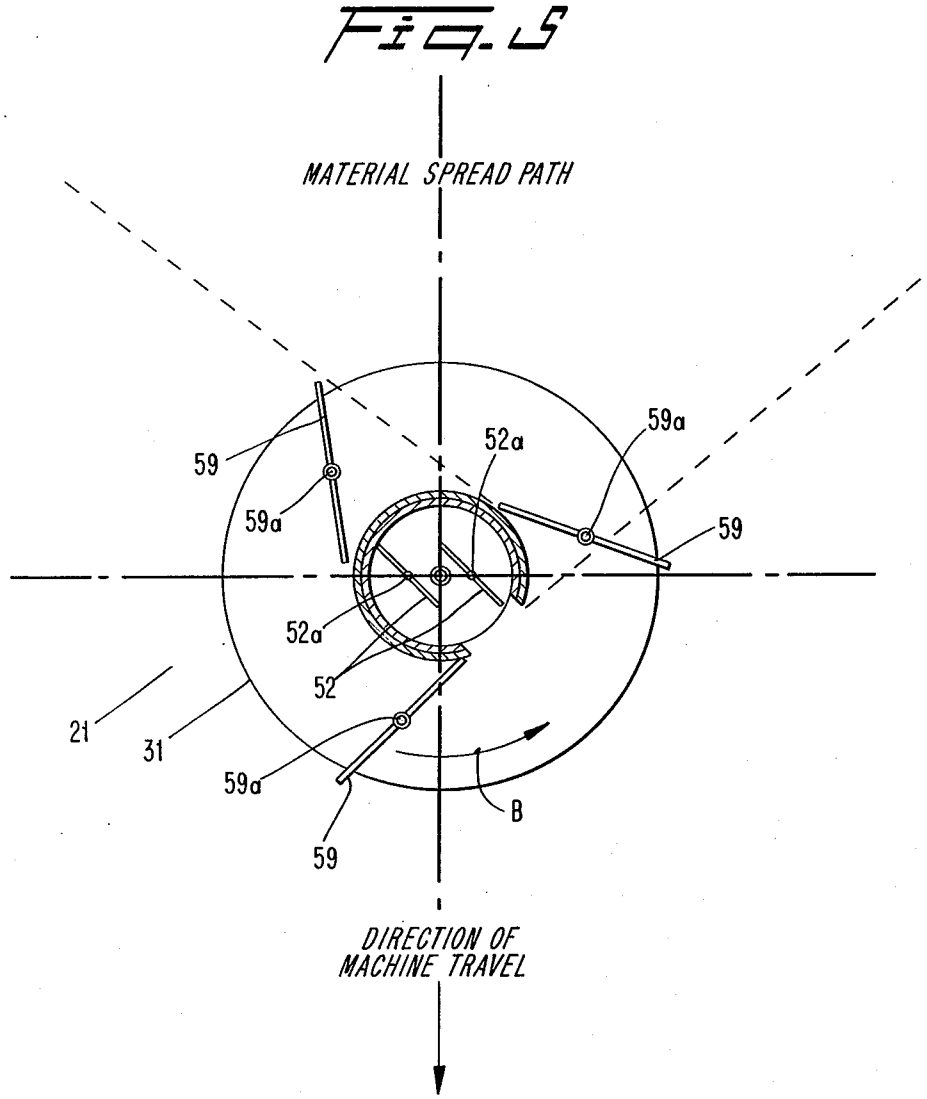
FIG. 5 shows a top view of the spinner shown in FIG. 3, with schematic representation of the flow of overlay material.

With further reference to FIG. 3, the collars 37 and 41 are open in the downward direction and the opening formed thereby is covered by a central plate 51 of a distribution plate 49. As seen in FIG. 3, the distribution plate 49 has the central plate 51 centrally mounted thereon and the outer periphery of the central plate 51 is sized so as to be insertable within the inner collar 37 and so as to be rotatable therein. The distribution plate 49 is supported in a position enabling the central plate 51 to enter the inner collar 37 by virtue of the drive shaft 55 of a hydraulic motor 53 supplied with hydraulic fluid by the lines 55, 57. Such support is accomplished through a bracket fixing the position of the hydraulic motor 53 in a manner well known to those skilled in the art. Accordingly, supply of the hydraulic fluid to the hydraulic motor 53 from a source not shown will result in spinning of the shaft 55 and the resultant spinning of the distribution plate 49 with respect to the fixed collars 37, 41. As seen in FIGS. 3 and 5 in particular, mounted on the plate 51 are two straight spreader paddles 52 designed to facilitate the movement of material redially outwardly toward the opening 43. The angle of the paddles may be adjusted by loosening bolts 52*a*.

As shown in FIG. 3, the distribution plate 49 has a plurality of elongated vanes 59 mounted thereon and extending slightly beyond the plate 49 periphery which vanes are designed to cause the spreading of asphalt overlay material which exits the opening 43 due to the force of gravity and the size of the opening 43. The angle of the vanes 59 may be adjusted by loosening bolts 59*a*. As should be understood, the distribution plate 49 rotates in the direction of the arrow B. FIG. 5 shows the spread path of material which has exited the opening 43 and has been spread by the plate 49 and attached vanes 59.

With reference to FIG. 2, it is seen that the left-hand and right-hand distribution plates 49 rotate in opposite directions. Further, it should be noted that the openings 43 formed by the collars 37, 41 are located so as to face in a direction approximately 45° from both the longitudinal axis of the device 10 and its transverse axis. Such location of the openings 43 is specifically designed because as asphalt overlay material is discharged through the openings 43 and is spread by the action of the vanes 59, a larger amount of material is spread to the sides of the device 10 and less material is spread toward the center thereof due to the fact that material spread toward the center of the device 10 must travel approximately ½ a revolution of the distribution plate 49 to do so. Thus, with the openings 43 located as shown in the Figure, each distribution plate 49 will spread a thicker overlay to the outside of the device 10 and a thinner toward the longitudinal central axis thereof. Thus, the operator of the device 10 should set the speed of the distribution plates 49 so that there is an overlap in the area covered by the throw of the two distribution plates 49 whereby the overlap adjacent to the longitudinal axis of the device 10 will make up for the thinness of the layer spread in the inward direction of the distribution plates 49 as opposed to the outward direction thereof. Thus, the skilled operator of the device 10 through skillful manipulation of the supply of asphalt overlay material through the opening 27 and skillful control of its discharge via the distribution plate 49 can maintain a substantially uniform layer of asphalt overlay material throughout the width of the layer even when that width extends laterally to both sides of the device 10 as is normally the case when it is desired to pave a 12 foot wide swath of roadway surface as is customary in the art. It should be noted that the design of the spinners is calculated to minimize non-uniformities in overlay material spread thickness.

As has been explained hereinabove, in order to effectively repave a road surface including the application of an overlay, all of the steps which are undertaken in scarifying and overlaying the road surface must be undertaken with the roadway to be treated being elevated to a temperature of at least 225° F. Thus, as explained hereinabove, the heater-scarifier-screed apparatus maintains the above-described temperature due to the heating aspect thereof. In a further aspect, if the asphalt overlay material contained within the hoppers 11, 21, 23 is not maintained at a sufficiently elevated temperature, it will tend to stick to the sides and interior surfaces of the hoppers, thereby impeding the smooth flow of the asphalt overlay material along the conveyors 17, 19, into the hoppers 21, 23 and out the outlets 27. Thus, in order to better facilitate the conveyance of the asphalt overlay material through the openings 27 of the hoppers 21 and 23, suitable heating devices may be utilized in conjunction with the hoppers 21 and 23. In this regard, as best seen in FIG. 1, an elongated tubular element 61 may be centrally located and supported within each of the hoppers 21 and 23 with the heating element 61 being supplied with heat through a source of propane, electrical means or other heating source which causes heat to radiate radially outwardly therefrom within the hopper 21, 23 to radiantly heat the asphalt overlay material contained therein. As a further measure, additional heating elements 63 may be provided on exterior surfaces of the hoppers 21, 23 to thereby heat the interior surfaces of the walls of the hoppers 21, 23 through heat radiation through the walls thereof.

In this way, through the combination of heat directly applied to the asphalt overlay material within the hoppers and the further application of heat through the walls of the hoppers, the elevated temperature of the asphalt overlay material is maintained in a manner so that it will not stick to the sides of the hoppers 21, 23 and will easily flow through the openings 27 to the spinner mechanisms 30.

Before discussing in detail the floating screed best seen in FIGS. 1 and 2, it is important to note that in the prior art, it has been attempted to spread an overlay on a paved surface through the use of a rotary distribution plate. In those systems known to applicants, only a single spinning mechanism is utilized and the discharge from the hopper of overlay material to the distribution plate is vertical from an elevated height. Thus, the overlay material which is conveyed to the distribution plate drops from an elevated height and thereby bounces upwardly from the distribution plate in an uncontrolled manner thereby causing nonuniform discharge from the distribution plate. This coupled with the fact that a single distribution plate will result in an uneven distribution of material in the lateral direction as explained hereinabove, results in a complete lack of effectiveness of such known prior art systems. Furthermore, the failure of such prior art systems to incorporate heating into the hopper systems results in clumping of the overlay material and further tendency to have nonuniformity in the discharge.

Further, in this regard, it is crucial to the effectiveness of this invention and associated method that the discharge from the hoppers to the distribution plates be substantially lateral. With lateral discharge to the distribution plates, the bouncing of the overlay material is completely eliminated and the control of distribution afforded by the vanes 59 is completely effective to distribute the overlay material in a controlled, predictable manner. Since the hoppers are provided with heating means, clumping of the overlay material does not occur and thus, the combination of heating and lateral discharge to the distribution plates will result in a completely predictable uniform coating of the repaved asphalt surface. These factors in conjunction with the fact that two spinner mechanisms 30 are utilized in the present invention will result in the ability to create an asphalt overlay extremely thin but resulting in substantially complete elimination of voids.

Figure 4:
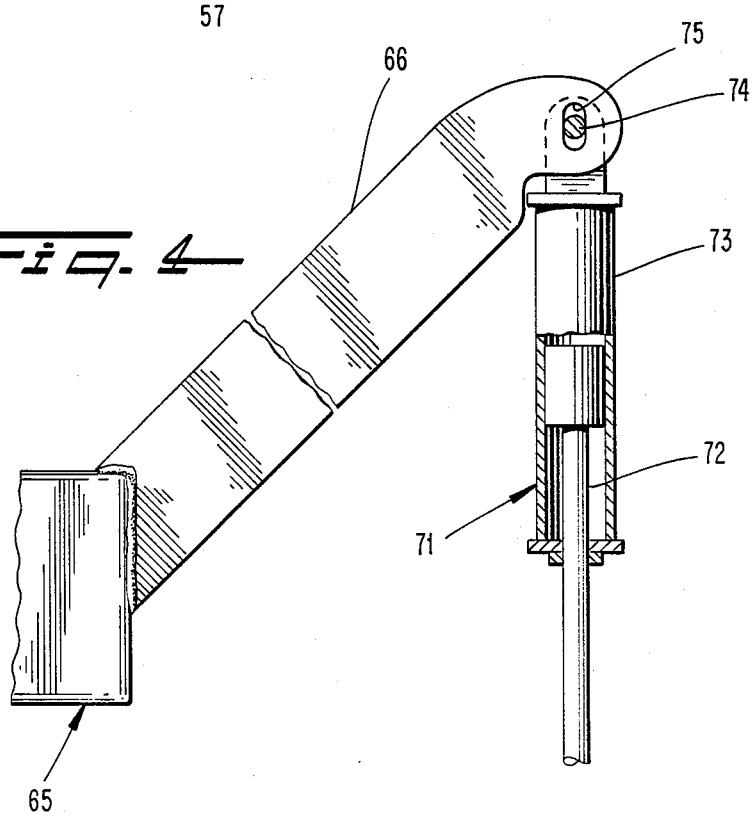
FIG. 4 shows in detail the interconnection of the floating screed shown in FIGS. 1 and 2 with the frame of the overlay spreading device.

Now, with further reference to FIGS. 1, 2 and 4, it is seen that the rear of the device 10 is provided with a bracket 65 consisting of longitudinally extending supports 67 and a horizontal connecting bracket 68 connecting the supports 67. Attached to the bracket 65 is a support mechanism 60 including lower arms 61 pivotably connected between the bracket 68 and screed 80 face 82, an upper arm 62 pivotably connected between a mount 62 attached to the bracket 68 and screed face 82, and a ram 71 connected between mount 64 attached to bar 63 (which is connected between lower arms 61) and mount 66 connected to frame 65 bracket 68. As best seen in FIG. 1, the upper arm 62 and lower arms 61 combine to form a parallelogram support mechanism which guides the screed 70 in pivotal movements with respect to the bracket 65 in smooth, controlled fashion. The piston rod 72 end is pivotably connected to mount 64. In a further aspect, the screed 70 is mounted on the amount 66 via the cylinder 73 of the ram 71. As seen in FIG. 4, the cylinder 73 has a mounting device 77 at its uppermost portion, which mounting device surrounds an end of the mount 66, whereupon a pin 74 is extended two aligned openings formed in the member 77 to thereby couple the member 77 and thereby the ram 71 to the mount 66 to thereby mount the screed 70 to the rear portion of the device 10.

It should be understood that the screed 70 is specially designed for use as an integral part of the present invention. In the preferred embodiment of the present invention, the screed 70 includes provision for heating as well as vibration. As has been explained hereinabove, the normal purpose for a screed is to define the thickness of the spread material by striking off a level and maintaining that level regardless of forces applied thereto to thereby establish the level of the finished pavement. As should be recalled, the level of the pavement was previously established through the screed which is at the rear of the heater-scarifier-leveling mechanism disclosed in U.S. Pat. No. 3,970,404. The purpose for the screed 70 of the present invention is merely to smooth the material which has been discharged by the spinner mechanisms 30 so that the material discharged therefrom will be more likely to fill the voids in the recycled surface. The screed 70 does not appreciably strike off the material discharged by the spinner mechanisms 30, but, rather, merely smoothes the overlay material which has already been evenly discharged by the spinner mechanisms 30. For this purpose, with reference to FIG. 4, the opening 75 in the mount 66 is vertically elongated so that the pin 74 of the member 77 seen in FIG. 2 may reciprocate up and down with respect to its centrally located position shown in FIG. 4. In this way, the screed 70 does *not* in fact strike off a predetermined level, but, rather, floats up and down due to impingements with material over which it flows and through its heating and vibratory functions evenly smooths and spreads the asphalt overlay material which has been discharged by the spinner mechanisms 30 so that the asphalt overlay material accurately enters all voids in the repaved surface. While the ram 71 may be utilized to set the level of the screed with respect to the pavement, the play in the level of the screed which is caused by the vertical length of the opening 75 causes the smoothing effect as described hereinabove. Further, the heating function of the screed 70 acts to maintain the temperature of the repaved pavement including the asphalt overlay material at at least 225° F. so that the so overlayed road surface is still sufficiently pliable that it may be compressed by a roller.

Figure 7:
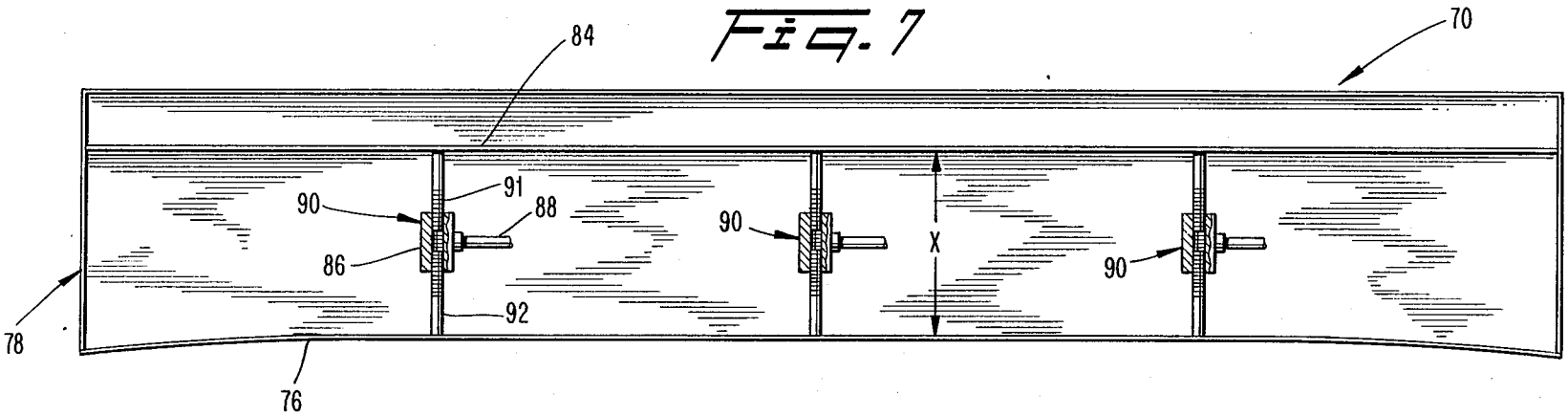
FIG. 7 shows a rear view of the screed showing the crown adjustment thereof.

In another aspect referring to FIG. 7, the screed 70 is seen to include a flexible bottom plate 76 attached to the screed housing 78 by ratchet binders 90 each having a first threaded member 91 rigidly attached to the upper wall 84, a second oppositely threaded member 92 rigidly attached to the flexible bottom plate 76 and a reversible ratchet mechanism 86 interconnecting the threaded members 91, 92. As should be understood, rotation of the ratchet mechanism using handle 88 in one direction will elongate the dimension "X" of the ratchet binder 90 while rotation in the opposite direction will shorten the dimension "X". Since each of the binders 90 is individually adjustable, by selective adjustment thereof, the plate 76 may be made to adopt a desired curvature corresponding to the desired configuration of the finished road surface. In practicing the teachings of the inventive method it is recommended that the flexible plate 76 be adjusted to define uniform spacing from the road surface prior to commencing to recycle the asphalt thereof through the use of the heater-scarifier-screed mechanism described in U.S. Pat. No. 3,970,404, provided it is desired to duplicate the existing contour of the crown of the road surface in the finished recycled and repaved surface. If it is desired to change this contour during recycling and repairing, the flexible plate 76 is adjusted to define the desired contours. In another aspect, the screed of the heater-scarifier-screed mechanism may be provided with the same adjustment mechanism so that the desired contour may be more effectively attained.

After the screed 70 has passed over the repaved road surface including the asphalt overlay material and has provided smoothing function, a roller mechanism not shown closely follows the device 10 to compact and compress the repaved road surface with asphalt overlay material smoothed thereover so that a smoothed finished road surface will result.

Figure 8:
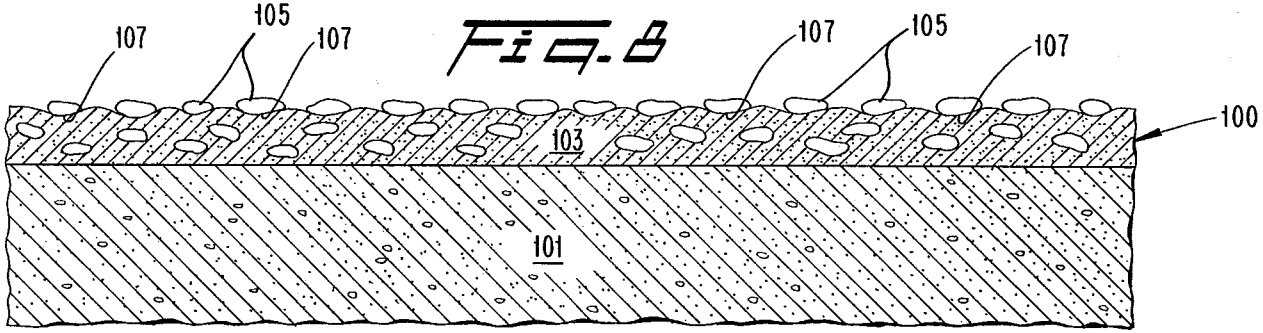
FIG. 8 shows a cross-sectional view through a road surface which has been repaved and wherein the overlay spreading device of the present invention has been utilized to spread an overlay thereover.
Figure 9:
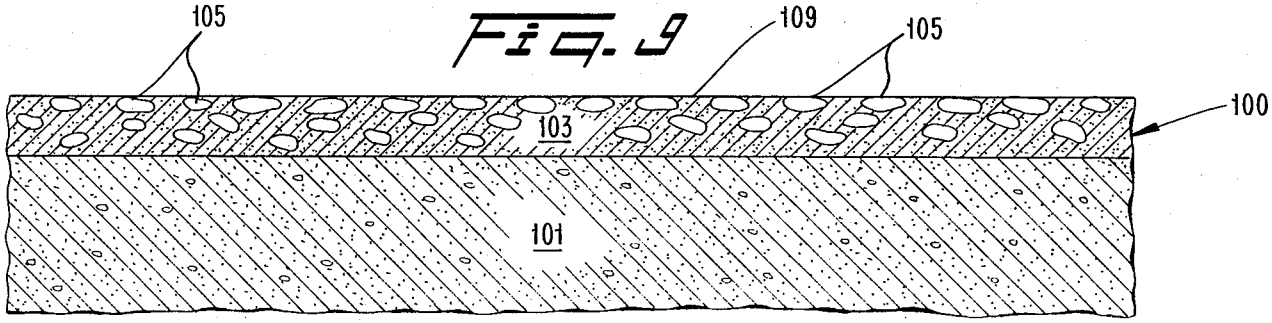
FIG. 9 shows a cross-sectional view through the same road surface illustrated in FIG. 5, but after the rolling step has been completed.

In this regard, reference is now made to FIGS. 8 and 9. FIG. 8 shows a cross-sectional view through a road 100 which includes an existing sub-base 101, a layer of repaved material 103 which repaving has been accomplished in accordance with the teachings of U.S. Pat. No. 3,970,404 and a layer of overlay including aggregate material 105. As is seen with reference to FIG. 8, the repaved layer 103 has a plurality of voids 107 in the surface thereof. As should be understood from FIG. 8, after the spinner mechanisms 30 have spread the asphalt overlay material over the repaved layer 103, and the floating screed 70 has performed its smoothing function, the aggregate 105 forming a part of the asphalt overlay material is resting within the voids 107 formed in the recycled layer 103 and, as seen in FIG. 8, the aggregate 105 extends outwardly from the uppermost surfaces of the repaved later 103.

Figure 6:
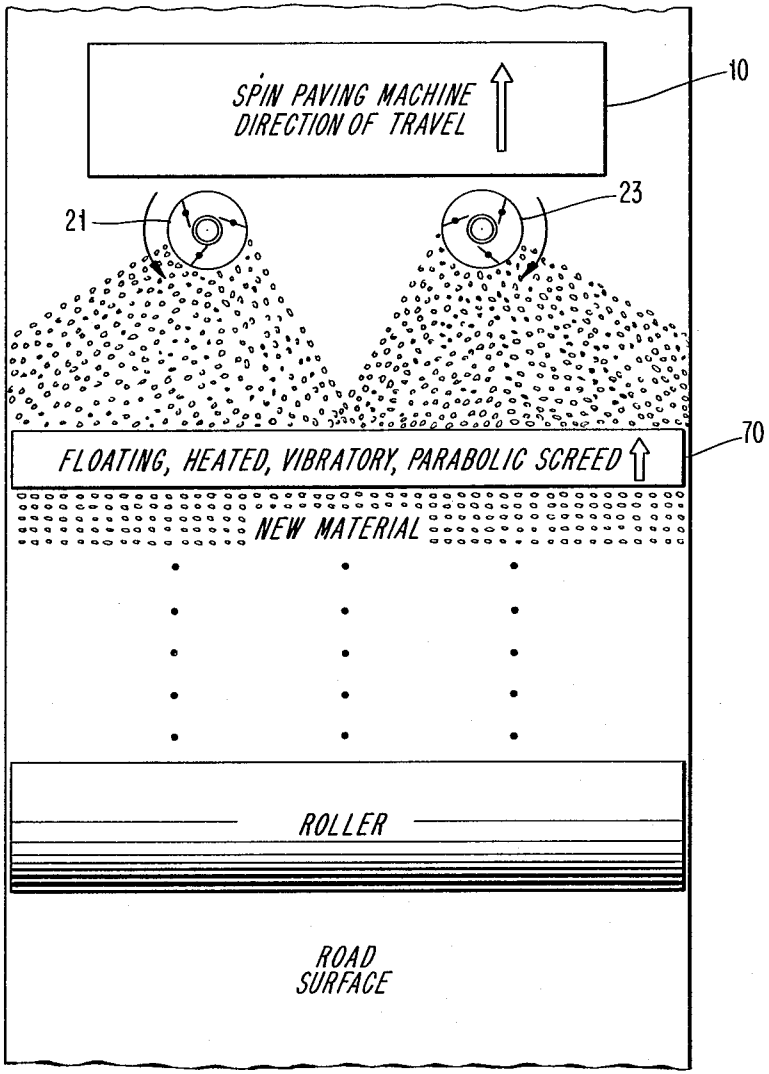
FIG. 6 shows a schematic representation of the main aspects of the inventive process and apparatus.

FIG. 8 should be compared to FIG. 9 which shows the same road surface in the same location after the roller has rolled over the asphalt overlay material. As should be seen in FIG. 9, the aggregate 105 has been compressed into the voids 107 until the aggregate 105 is just at the surface of the repaved layer 103 thereby filling all of the voids and resulting in a completely smooth top surface 109 for the finished road surface. In this way, with reference to FIG. 9, the voids 107 which were present in FIG. 8 have been substantially completely eliminated by the distribution, smoothing and compression of the asphalt overlay material including aggregate 105 into the voids 107 originally formed in the repaved layer 103. In this way, through the teachings of the present invention, an extremely thin overlay layer, usually very close to 1/7 inch thickness, has been utilized to completely smooth the finished pavement surface. FIG. 6 shows how the spinners 21, 23 and screed 70 combine in function to smoothly and evenly spread the overlay so all voids are filled. In FIG. 6, the view above the roller corresponds to FIG. 8 whereas the view below the roller corresponds to FIG. 9.

Before discussing in detail the method steps which are utilized in applying the teachings of the present invention as embodied in the device 10, it must be noted that the various components and structures of the inventive device 10 may be operated through the use of structures and devices well known to those skilled in the art. For example, as described hereinabove, the spinner mechanisms 30 may be rotated through the use of hydraulic motors supplied through a source of hydraulic fluid and a hydraulic pump. Furthermore, the device 10 itself includes wheels 12, 14 which may drive and steer the device 10 through any desired means such as hydraulic pump-motor systems. Furthermore, further hydraulic control mechanisms may be utilized in operating the rams 15, 71 and further similar devices may be utilized to operate the conveyors 17, 19. These aspects of the present invention do not form a significant aspect of the present invention since one skilled in the art is aware of devices which may be used to rotate drive wheels, rotate spinners, operate conveyors and tilt walls of hoppers.

Now, the method steps which are undertaken through the use of the device 10 will be reviewed. First, if the contour of the road surface to be recycled and repaved is to be maintained, the screed 70 bottom plate 76 is adjusted as explained above to define even spacing from the road surface. Corresponding adjustments may be made to the screed of the heater-scarifier-screed device. If, on the other hand, it is desired to establish a new contour, then the screeds are adjusted so that the flexible bottom plates thereof define the new contour. In many situations, a parabolic contour is desirable. Then, with reference, again, to U.S. Pat. No. 3,970,404, the pavement to be treated is operated upon using the first 6 steps noted in the sole figure in U.S. Pat. No. 3,970,404 culminating with the leveling step wherein the fixed screed is utilized to strike off a particular spacing which defines a level of the repaved pavement. Thereafter, following closely behind the screed of the heater-scarifier-screed device, the device 10 of the present invention follows with asphalt overlay material contained within the front hopper 11, conveyed by the conveyors 17, 19 to the heated rear hoppers 21, 23, conveyed by gravity to the discharge openings 27 and thereafter to the lateral discharge openings 43 of the concentric collars 37, 41 which openings 43 have been adjusted based upon operator experience so as to control the amount of material which may be discharged laterally out the openings 43 per unit time.

With the distribution plates 49 rotating at a speed based upon operator experience designed to spread the material in a predetermined radius away from the distribution plate 49, the asphalt overlay material is spread from both distribution plates 49 through rotation in their respective directions B and C of the plates 49. The vanes 59 distribute the asphalt overlay material in a manner due to the orientation of the openings 43 with respect to the body of the device 10 so that an even distribution of the asphalt overlay material is accomplished in a direction perpendicular to the longitudinal axis A of the device 10. Once the material has been spread by the distribution plates 49 onto the recycled surface, the floating screed 70 through its vibratory, floating, heating and parabolic functions smooths the material including the aggregate 105 until the overlay material substantially completely fills all voids 107 in the recycled layer 103. The heat supplied by the screed 70 maintains the temperature of the recycled layer and overlay at at least 225° F. to maintain the recycled and overlayed surface pliable and to better facilitate the flowing of the material under the flexible plate 76 thereof.

Immediately thereafter, a roller mechanism is driven over the overlayed repaved road surface to thereby cause the aggregate 105 in the overlay to be compacted within the voids 107 of the repaved layer 103 to thereby result in the smooth surface 109 seen in FIG. 6 on the finished roadway. Thereafter, a rejuvenator substance may be sprayed over the overlayed repaved road surface to thereby seal the finished surface and protect the pavement. An example of a rejuvenation coating which may be applied to a pavement surface is known by the trademark CRF TM and is manufactured by the Witco Chemical Corporation, Los Angeles, Calif. In accordance with the teachings of the present invention, the rejuvenation step may be accomplished as much as 1 week after the rolling operation. However, applicants have found that the most effective use of rejuvenation results when rejuvenation is carried out the same day as the rolling step.

While the optimal use of the inventive device 10 is in conjunction with the repaving steps delineated hereinabove, other uses for the device 10 have been discovered by applicants. For example, the inventive device 10 may be utilized to put an extremely thin layer of asphalt on top of an existing gravel or dirt road. In other words, it may be used to thinly pave an asphalt layer on any surface. In circumstances wherein an uneven surface exists, for example, a dirt parking lot having holes here and there, the inventive device 10 may be utilized to pave a thin layer of asphalt over the entire parking lot surface whereupon compaction through the use of a roller is operative in conjunction with the operation of the device 10 to eliminate any dust problems which previously existed through the use of a dirt parking lot. In such an application, the screed 70 is raised and deactivated and the spinners 21, 23 are the sole distribution device used. Such results are not known in prior art devices and such devices would normally be required to lay a much thicker layer of material over a dirt road or gravel surface.

As is well known to those skilled in the art, a ⅝ inch thick surface of asphalt overlay material weighs approximately 90 pounds per square yard. The inventive device 10 may be adjusted so that an overlay may be placed over the repaved road surface at a density of from 3 to 40 pounds per square yard. Thus, even at its thickest, the overlay which is applied through the teachings of the present invention is less than half the thickness of the minimum overlay which must be applied using prior art techniques.

As the present invention is devised, the hopper 11 is designed for a capacity of approximately 6 tons of asphalt material. In accordance with the teachings of the present invention, it has been found that one load of 6 tons of material will last as long as 25 tons of material through the use of prior art devices. Thus, the savings in energy, expense and labor delineated hereinabove are clearly demonstrable.

In a further aspect, the thickness of the overlay may be adjusted in several ways. Firstly, as the speed of rotation of the distribution plates 49 is increased, the overlay is spread over a much wider area but more thinly. Furthermore, as the opening 43 is increased or decreased, respective increases and decreases in the thickness of the overlay are accomplished. Furthermore, if the speed of forward movement of the device 10 is increased, the thickness of the overlay is correspondingly decreased and vice-versa.

In a further aspect, if desired, either the wheels 12 or 14 may be pivotable for steering purposes. Applicants have found, however, that if the wheels 12 are the steering wheels, the device 10 may turn on a much tighter radius which is highly desirable.

Additionally, with reference to FIGS. 1 and 2, at the rear of the screed 70 a platform 80 is provided on which the operator of the device may stand. A control box 81 is provided which includes valve controls 83 to control the various system functions including operation of the conveyors 17, 19, pivoting of the hopper 11 walls 13, rotation of the plates 49, adjustments of the ram 73, driving and steering of the device 10, etc. Additionally, a separate seat 85 and steering mechanisms 87 are provided so that an operator of the device 10 may sit in the seat 85 and steer through the use of the steering wheel 87 to drive the device 10 to a point of use whereupon the operator will normally stand on platform 80 to operate the device 10. Further, hydraulic controls may be provided so that each distribution plate 49 may be independently actuable to its own speed to thereby vary the width of the swath covered by the overlay material accordingly.

In a further aspect, the screed 70 utilized in the present invention may have an adjustable width so that when the distribution plates 49 are adjusted in speed so as to increase the swath of coverage of the overlay material, the width of the screed 70 may be correspondingly laterally adjusted so that its smoothing functions cover the entirety of the swath which has been spread by the distribution plates 49. If desired, the distribution plates 49 may also be heated to aid in maintaining the temperature of the overlay material at a maleable level.

Accordingly an invention has been described in terms of apparatus and method of use which overcomes the deficiencies found in prior art devices and methods and which provides an improved apparatus and method for paving a road surface with a much thinner layer than contemplated by the prior art, more effectively and with great savings in energy, time, labor and money. Of course, variations, changes, alterations and modifications in the teachings of the present invention as delineated above may be contemplated by those skilled in the art without departing from the intending spirit and scope thereof. Accordingly, it is stressed that it is intended that the present invention only be limited by the terms of the appended claims.

What is claimed:

1. A method of recycling and repaving an asphalt pavement surface of a road including the steps of:

(a) heating said pavement surface to a temperature sufficiently high to cause said pavement to soften and maintaining said pavement surface at least said temperature throughout said method;

(b) scarifying said surface to a depth not exceeding the depth to which the asphalt thereof has been softened;

(c) leveling said scarified surface to a desired contour;

(d) spreading a thin overlay of overlay material on said leveled surface, said overlay material filling substantially all voids created in said surface by steps (a), (b) and (c); and (e) rolling the overlayed leveled surface to provide a smooth trafficable road surface which is substantially free of voids, said spreading step being accomplished by counterrotating two spinners each supplied with overlay material from a lateral discharge port of a subchamber provided for each spinner, said spinners each having mounted thereon a plurality of distribution vanes.

2. The method of claim 1, wherein between said spreading and rolling steps, further including the step of smoothing said overlay.

3. The method of claim 2, where said smoothing step is carried out by (a) providing a floating screed, and (b) vibrating and heating said floating screed.

4. The method of claim 2, wherein said smoothing step is carried out by providing a floating screed having a bottom surface of adjustable contour, and said method further including the step of adjusting said contour to a shape corresponding to the desired contour of said trafficable road surface prior to said heating step.

5. The method of claim 1, wherein said spinners comprise a left-hand spinner and a right-hand spinner, said left-hand spinner spinning counter-clockwise and said right-hand spinner spinning clockwise.

6. The method of claim 5, wherein said spinners are moved forward generally in the direction of a longitudinal axis substantially perpendicular to an imaginery transverse line intersecting the rotation axes of said spinners, the discharge ports of said sub-chambers each facing in an oblique forward direction approximately halfway between said longitudinal axis and transverse line, and respectively being located on opposed sides of said longitudinal axis.

7. The method of claim 1, further wherein each said subchamber has rotatably mounted therein a distribution plate having a plurality of adjustable distribution paddles thereon.

8. The method of claim 1, further including the step of heating said overlay material prior to conveying said overlay material to said sub-chambers.

9. The method of claim 1, wherein said spinners are rotated at a speed of between 10 and 50 revolutions per minute.

10. The method of claim 1, wherein said method adds no more than ⅝ of an inch of thickness of overlay material to the road surface as compared to the thickness of said road prior to practicing said method thereon.

11. The method of claim 10 wherein said overlay material includes aggregate made up of individual stones of up to ⅝ inch in their longest dimension.

12. The method of claim 1, wherein said method adds no more than approximately 1/7 of an inch of thickness of overlay material to the road surface as compared to the thickness of said road prior to practicing said method thereon whereby road fixtures such as manhole covers, water boxes and inlet basins need not be adjusted.

13. The method of claim 12 wherein said overlay material includes aggregate made up of individual stones of up to ⅝ inch in their longest dimension.

14. The method of claim 1, wherein each said subchamber is substantially cylindrical.

15. The method of claim 1, wherein said distribution vanes are adjustable.

16. A method of repairing a heated, scarified and leveled asphalt pavement surface of a road, including the steps of:

(a) maintaining the temperature of said surface sufficiently high enough to maintain said surface in a softened state;

(b) spreading a thin overlay of overlay material on said softened surface, said material filling substantially all voids in said surface, said spreading step being accomplished by counterrotating two spinners each supplied with overlay material from a lateral discharge port of a subchamber provided for each spinner, each spinner having distribution means thereon for distributing said overlay material therefrom; and (c) rolling said surface to provide a smooth trafficable road surface.

17. The method of claim 16, wherein said method adds no more than ⅝ of an inch of thickness of overlay material to the road surface as compared to the thickness of said road prior to practicing said method thereon.

18. The method of claim 17 wherein said overlay material includes aggregate made up of individual stones of up to ⅝ inch in their longest dimension.

19. The method of claim 16, wherein said method adds no more than approximately 1/7 of an inch of thickness of overlay material to the road surface as compared to the thickness of said road prior to practicing said method thereon whereby road fixtures such as manhole covers, water boxes and inlet basis need not be adjusted.

20. The method of claim 19 wherein said overlay material includes aggregate made up of individual stones of up to ⅝ inch in their longest dimension.

21. A method of providing an asphalt overlay on a ground surface comprising the steps of:

(a) providing an overlay spreading device including two counterrotating spinners, each spinner having a plurality of distribution vanes thereon and adapted to be supplied with overlay material laterally discharged from a port of a supply chamber for said material, a separate supply chamber being provided for each spinner;

(b) heating said material to a sufficiently high temperature to render said material soft, pliable and less likely to stick to surfaces of said device;

(c) supplying said heated material to said chambers and thence laterally to said spinners;

(d) distributing said material on said surface by controlled rotation of said spinners; and (e) rolling said overlay to provide a smooth trafficable road surface.

22. The method of claim 21, further including the step of smoothing said overlay prior to said rolling step.

23. A method of repaving a recycled asphalt pavement, while said recycled pavement is maintained at a sufficiently high enough temperature so as to maintain said recycled pavement in a soft compactable state, said recycled pavement having a surface having a plurality of voids therein, said method including the steps of:

(a) discharging, as a single step, an amount of overlay material evenly on the surface of said pavement sufficient to fill said voids without appreciably raising the elevation of said surface;

(b) leveling said overlay material without appreciably striking off said overlay material, said leveling step merely smoothing said overlay material which has already been evenly discharged; and (c) compacting said overlay material and recycled pavement into a homogeneous, smooth pavement surface not appreciably elevated from the elevation of said surface prior to said discharging step.

24. The method of claim 23, wherein said temperature is at least 225° F.

25. The method of claim 23, wherein said leveling step is carried out by a floating screed.

26. The method of claim 23, wherein after said compacting step, road fixtures need not be elevated.

27. An apparatus for spreading an overlay of asphalt paving material on a recycled road surface comprising:

(a) front storage means for storing a load of said material;

(b) rear storage means;

(c) conveyor means for supplying said material from said front storage means to said rear storage means;

(d) said rear storage means having two laterally spaced outlets, each said outlet leading to a subchamber;

(e) each said subchamber having a lateral outlet port;

(f) distributor means rotatably mounted below each subchamber for evenly distributing said material, each said distributor means comprising:

(1) a substantially flat plate; and (2) a plurality of vanes mounted on said plate;

(g) first drive means for controllably counterrotating said plates, each subchamber having mounted therein a further rotary plate constrained to move with the flat plate corresponding to the subchamber in which the rotary plate is contained, each said rotary plate having a plurality of adjustable distribution paddles mounted thereon; and (h) second drive means operable independently of said first drive means for moving said apparatus along said road surface.

28. The invention of claim 27, wherein said front storage means includes side walls selectively pivotable to adjust the angle of inclination thereof.

29. The invention of claim 27, wherein said rear storage means includes heating means for maintaining said material within a predetermined temperature range.

30. The invention of claim 29, wherein said heating means comprises a first heating element within said rear storage means for heating said material by direct radiation and a second heating element outside said rear storage means for heating said material through walls of said rear storage means, said second heating element substantially preventing sticking of said material to said walls.

31. The invention of claim 27, wherein each said lateral outlet port has an adjustable opening.

32. The invention of claim 27, wherein said vanes are rotatably adjustable with respect to said plate.

33. The invention of claim 27, wherein said distribution paddles are rotatably adjustable with respect to said further rotary plate.

34. The invention of claim 27, wherein said apparatus has a longitudinal axis substantially perpendicular to an imaginary transverse line intersecting the rotation axes of said plates, said lateral outlet ports each facing in an oblique forward direction approximately halfway between said longitudinal axis and transverse axis and respectively being located on opposed sides of said longitudinal axis.

35. The invention of claim 27, wherein a floating smoothing device is mounted on said apparatus behind said distributor means, said floating smoothing device being operative to smooth said material which has been distributed by said distributor means.

36. The invention of claim 35, wherein said smoothing device is connected to a frame portion of said apparatus by virtue of connection means comprising an elongated vertically extending slot in one of said frame portion and said smoothing device, and a pin extending transversely through said slot and attached to the other of said frame portion and said smoothing device, said connection means allowing up and down movement of said smoothing device with respect to said road surface.

37. The invention of claim 35, wherein said smoothing device includes vibratory means for imparting vibration thereto.

38. The invention of claim 35, wherein said smoothing device includes heating means for facilitating the movement of said smoothing device over material distributed by said distributor means.

39. The invention of claim 35, wherein said smoothing device includes a flexible bottom plate adapted to face said road surface to define a predetermined contour and adjustment means for controllably adjusting the contour of said flexible bottom plate.

* * * * *